US007796096B2

(12) United States Patent
Shim et al.

(10) Patent No.: US 7,796,096 B2
(45) Date of Patent: Sep. 14, 2010

(54) PLASMA DISPLAY APPARATUS

(75) Inventors: Kyung Ryeol Shim, Gumi-si (KR); Jong Hak Lee, Pohang-si (KR)

(73) Assignee: LG Electronics Inc., Seoul (KR)

( * ) Notice: Subject to any disclaimer, the term of this patent is extended or adjusted under 35 U.S.C. 154(b) by 804 days.

(21) Appl. No.: 11/619,219

(22) Filed: Jan. 3, 2007

(65) Prior Publication Data

US 2008/0012795 A1 Jan. 17, 2008

(30) Foreign Application Priority Data

Jul. 14, 2006 (KR) ..... 10-2006-0066420

(51) Int. Cl.
*G09G 3/28* (2006.01)

(52) U.S. Cl. ..... 345/60

(58) Field of Classification Search ..... 345/60–73; 315/169.1–169.4

See application file for complete search history.

(56) References Cited

U.S. PATENT DOCUMENTS 6,294,875 B1 * 9/2001 Kurata et al. ..... 315/169.1
7,053,869 B2 * 5/2006 Choi ..... 345/60
7,365,709 B2 * 4/2008 Kim et al. ..... 345/60
7,456,808 B1 * 11/2008 Wedding et al. ..... 345/63
2004/0085262 A1 * 5/2004 Lee ..... 345/41
2004/0119665 A1 * 6/2004 Kang et al. ..... 345/63
2005/0024294 A1 * 2/2005 Kim et al. ..... 345/60
2005/0073480 A1 * 4/2005 Kim et al. ..... 345/60
2005/0200563 A1 * 9/2005 Kim et al. ..... 345/60
2005/0225505 A1 * 10/2005 Lee ..... 345/60
2005/0243027 A1 * 11/2005 Chung et al. ..... 345/60
2005/0264230 A1 * 12/2005 Kim et al. ..... 315/169.4
2006/0033682 A1 * 2/2006 Choi ..... 345/60
2006/0132389 A1 * 6/2006 Jung et al. ..... 345/63
2006/0164340 A1 * 7/2006 Chung et al. ..... 345/67
2006/0232512 A1 * 10/2006 Kim ..... 345/60

FOREIGN PATENT DOCUMENTS

EP 1662466 A2 * 5/2006

* cited by examiner

*Primary Examiner*—Alexander Eisen
*Assistant Examiner*—Patrick Marinelli
(74) *Attorney, Agent, or Firm*—Fish & Richardson P.C.

(57) ABSTRACT

Provided is a plasma display apparatus. The apparatus includes a plasma display panel having a plurality of discharge cells, and time-division driven by dividing a unit frame into a plurality of subfields, and a driver for supplying a reset signal for initializing the plurality of discharge cells to a scan electrode of the panel in a reset period. The driver supplies gradually rising setup signals to the scan electrode in reset periods of the plurality of subfields. An average slope of the setup signal supplied in a first subfield among the plurality of subfields is different from an average slope of the setup signal supplied in a second subfield.

18 Claims, 7 Drawing Sheets

PLASMA DISPLAY APPARATUS

This Nonprovisional application claims priority under 35 U.S.C. §119(a) on Patent Application No. 10-2006-0066420 filed in Korea on Jul. 14, 2006, the entire contents of which are hereby incorporated by reference.

BACKGROUND OF THE INVENTION

1. Field of the Invention

The present invention relates to a plasma display apparatus, and more particularly, to a plasma display apparatus including a driving device for supplying a reset signal to a plasma display panel to initialize a plurality of discharge cells.

2. Description of the Background Art

A plasma display panel refers to a device for displaying an image, by applying a predetermined voltage to electrodes installed in a discharge cell, inducing a discharge, and exciting a phosphor using plasma generated at the time of gas discharge.

The plasma display panel has an advantage that large-sizing and slimness are easy as well as a structure is simplified, thereby facilitating manufacture and increasing a luminance and a light emission efficiency compared with other flat panel displays.

The plasma display panel is time-division driven for a reset period for initializing all discharge cells, an address period for selecting the cell in which a discharge is to be induced, and a sustain period for inducing a sustain discharge in the selected cell. In general, the reset period is divided into a setup period for which a first voltage gradually rises to a second voltage, a fall period for which the second voltage abruptly falls to a third voltage, and a setdown period for which the third voltage gradually falls to a fourth voltage.

The conventional plasma display panel has a drawback in that a luminance point erroneous discharge, occurrence of flickering, and an increase of a black luminance result in deterioration of a picture quality of a display image. Further, it has a drawback in that the luminance point erroneous discharge more increases in a low temperature, and the flickering more increases in a high temperature.

SUMMARY OF THE INVENTION

Accordingly, the present invention is to solve at least the problems and disadvantages of the background art.

The present invention is to provide a plasma display apparatus for reducing luminance point erroneous discharge, flickering, and black luminance, thereby improving a picture quality of a display image.

To achieve these and other advantages and in accordance with the purpose of the present invention, as embodied and broadly described, there is provided a plasma display apparatus. The apparatus includes a plasma display panel having a plurality of discharge cells, and time-division driven by dividing a unit frame into a plurality of subfields, and a driver for supplying a reset signal for initializing the plurality of discharge cells to a scan electrode of the panel in a reset period. The driver supplies gradually rising setup signals to the scan electrode in reset periods of the plurality of subfields. An average slope of the setup signal supplied in a first subfield among the plurality of subfields is different from an average slope of the setup signal supplied in a second subfield.

In another aspect of the present invention, there is provided a plasma display apparatus. The apparatus includes a plasma display panel having a plurality of discharge cells, and time-division driven by dividing a unit frame into a plurality of subfields, and a driver for supplying a reset signal for initializing the plurality of discharge cells to a scan electrode of the panel in a reset period. The driver supplies gradually falling setdown signals to the scan electrode in reset periods of the plurality of subfields. An average slope of the setdown signal supplied in a first subfield among the plurality of subfields is different from an average slope of the setdown signal supplied in a second subfield.

In a further another aspect of the present invention, there is provided a plasma display apparatus. The apparatus includes a plasma display panel having a plurality of discharge cells, and time-division driven by dividing a unit frame into a plurality of subfields, and a driver for supplying a reset signal for initializing the plurality of discharge cells to a scan electrode of the panel in a reset period. The driver supplies gradually rising or falling ramp signals to the scan electrode in reset periods of the plurality of subfields. The ramp signal includes two or more rising or falling variation periods for which it gradually rises or falls with a third slope, and includes a sustain period for sustaining a predetermined voltage between two adjacent variation periods among the variation periods.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

Figure 1:
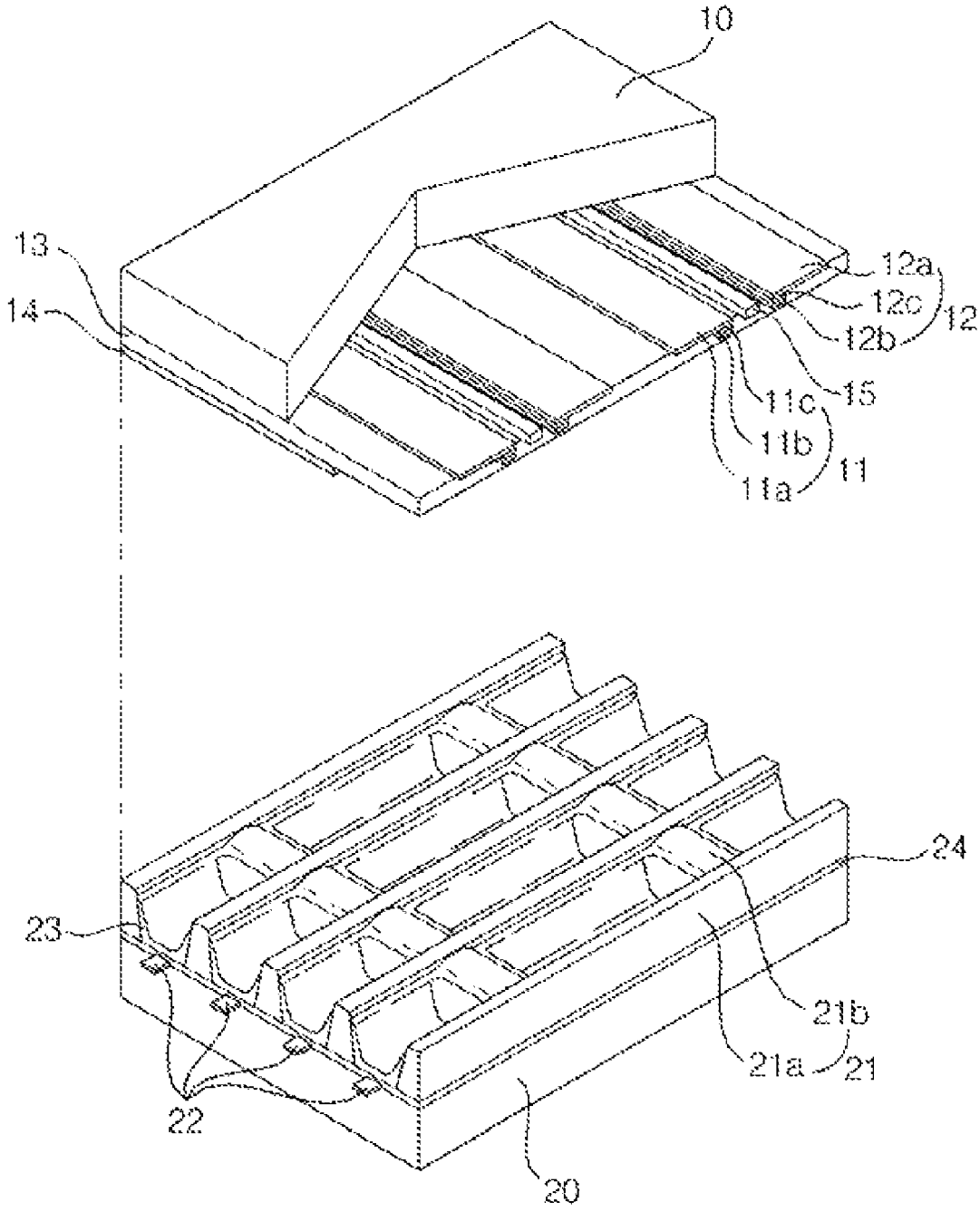
FIG. 1 is a perspective diagram illustrating a plasma display panel according to an exemplary embodiment of the present invention.

FIG. 1 is a perspective diagram illustrating a structure of a plasma display panel according to an exemplary embodiment of the present invention.

As shown in FIG. 1, the plasma display panel includes a scan electrode 11 and a sustain electrode 12 that constitute a sustain electrode pair formed on an upper substrate 10; and an address electrode 22 formed on a lower substrate 20.

The sustain electrode pair 11 and 12 includes transparent electrodes 11*a* and 12*a*, and bus electrodes 11*b* and 12*b*. The transparent electrodes 11*a* and 12*a* are formed of Indium-Tin-Oxide (ITO). The bus electrodes 11*b* and 12*b* can be formed of metal such as silver (Ag) and chrome (Cr). Alternately, the bus electrodes 11*b* and 12*b* can be of laminate type based on chrome/copper/chrome (Cr/Cu/Cr) or chrome/aluminum/chrome (Cr/Al/Cr). The bus electrodes 11*b* and 12*b* are formed on the transparent electrodes 11*a* and 12*a*, and reduce a voltage drop caused by the transparent electrodes 11*a* and 12*a* having high resistances.

In an exemplary embodiment of the present invention, the sustain electrode pair 11 and 12 can be of structure in which the transparent electrodes 11*a* and 12*a* and the bus electrodes 11*b* and 12*b* are laminated, as well as can be of structure based on only the bus electrodes 11*b* and 12*b*, excluding the transparent electrodes 11*a* and 12*a*. This structure is advantageous of reducing a panel manufacture cost because it does not use the transparent electrodes 11*a* and 12*a*. The bus electrodes 11*b* and 12*b* used for this structure can be formed of diverse materials such as photosensitive material in addition to the above-described materials.

A Black Matrix (BM) 15 is provided between the transparent electrodes 11*a* and 12*a* and the bus electrodes 11*b* and 12*b*(11*c*→12*b*) of the scan electrode 11 and the sustain electrode 12. The black matrix 15 performs a light shield function of absorbing external light emitting from an outside of the upper substrate 10 and reducing reflection, and a function of improving purity and contrast of the upper substrate 10.

In an exemplary embodiment of the present invention, the black matrix 15 is formed on the upper substrate 10. The black matrix 15 can be comprised of a first black matrix 15, and second black matrixes 11*c* and 12*c*. The first black matrix 15 is formed in a position where it overlaps with a barrier rib 21. The second black matrixes 11*c* and 12*c* are formed between the transparent electrodes 11*a* and 12*a* and the bus electrodes 11*b* and 12*b*. The first black matrix 15, and the second black matrixes 11*c* and 12*c* (called black layers or black electrode layers) can be concurrently formed in their forming processes, physically connecting with each other. Alternately, the first black matrix 15 and the second black matrixes 11*c* and 12*c* are not concurrently formed, physically disconnecting with each other.

The black matrix can be concurrently formed together with the above-described black layers in its forming process, physically connecting with each other. Alternately, the black matrix can be formed at a different time point, physically disconnecting from each other. The black matrix and the black layer are formed of same material in case where they physically connect with each other. However, the black matrix and the black layer are formed of different materials in case where they physically disconnect from each other.

An upper dielectric layer 13 and a protective film 14 are layered on the upper substrate 10 where the scan electrode 11 and the sustain electrode 12 are formed in parallel with each other. Charged particles generated by discharge are accumulated on the upper dielectric layer 13. The upper dielectric layer 13 can protect the sustain electrode pair 11 and 12. The protective film 14 protects the upper dielectric layer 13 against sputtering of the charged particles generated by the gas discharge. The protective film 14 enhances an efficiency of emitting secondary electrons.

The scan electrode 11 and the sustain electrode 12 can be formed on a predetermined black layer without directly contacting with the upper substrate 10 though it is not illustrated in FIG. 1. In other words, the black layer can be formed between the upper substrate 10 and the scan electrode 11 and the sustain electrode 12, thereby preventing the upper substrate 10 from being discolored because of the direct contact between the upper substrate 10 and the scan electrode 11 and the sustain electrode 12.

The address electrode 22 is formed in the direction of intersecting with the scan electrode 11 and the sustain electrode 12. A lower dielectric layer 24 and the barrier rib 21 are formed on the lower substrate 20 including the address electrode 22.

A phosphor layer 23 is formed on surfaces of the lower dielectric layer 24 and the barrier rib 21. The barrier rib 21 includes a vertical barrier rib 21*a* and a horizontal barrier rib 21*b* that are formed in a closed type. The barrier rib 21 physically distinguishes discharge cells, and prevents ultraviolet rays and visible rays generated by the discharge from leaking to neighbor cells.

In an exemplary embodiment of the present invention, the barrier rib 21 can have various shaped structures as well as a structure shown in FIG. 1. For example, there are a differential type barrier rib structure, a channel type barrier rib structure, and a hollow type barrier rib structure. In the differential type barrier rib structure, the vertical barrier rib 21*a* and the horizontal barrier rib 21*b* are different in height. In the channel type barrier rib structure, a channel available for an exhaust passage is provided for at least one of the vertical barrier rib 21*a* and the horizontal barrier rib 21*b*. In the hollow type barrier rib structure, a hollow is provided for at least one of the vertical barrier rib 21*a* and the horizontal barrier rib 21*b*.

It is desirable that the horizontal barrier rib 21*b* is great in height in the differential type barrier rib structure. It is desirable that the horizontal barrier rib 21*b* has the channel or hollow in the channel type or hollow type barrier rib structure.

In an exemplary embodiment of the present invention, it is shown and described that each of Red (R), Green (G), and Blue (B) discharge cells is arranged on the same line. Alternatively, the R, G, and B discharge cells can be arranged in a different type. For example, there is a delta type arrangement where the R, G, and B discharge cells are arranged in a triangular shape. The discharge cell can have a rectangular shape as well as a polygonal shape such as a pentagonal shape and a hexagonal shape.

The respective phosphor layers 23 of the R, G, and B discharge cells can be of symmetric structure where they are substantially the same as each other or different from each other in pitch and width, or of asymmetric structure where they are different from each other in pitch. In case where the phosphors 23 are different from each other in pitch in the R, G, and B discharge cells, respectively, the phosphor layer 23 of the G or B discharge cell can be greater in pitch than the phosphor layer 23 of the R discharge cell.

The phosphor layer 23 is excited by the ultraviolet rays generated by the gas discharge, and emits any one visible ray among Red (R), Green (G), and Blue (B). An inertia mixture gas such as helium plus xenon (He+Xe), neon plus xenon (Ne+Xe), and helium plus neon plus xenon (He+Ne+Xe) is injected for the discharge into a discharge space provided between the front and lower substrates 10 and 20 and the barrier rib 21.

In the plasma display panel according to an exemplary embodiment of the present invention, the R, G, and B discharge cells can be substantially the same as each other in pitch. Alternately, the R, G, and B discharge cells can be different from each other in pitch to adjust color temperatures of the R, G, and B discharge cells. In this case, the pitches can be all different at the R, G, and B discharge cells, respectively. Alternatively, only the pitch of the discharge cell displaying one color among the R, G, and B discharge cells can be different. For example, the pitch of the R discharge cell can be the smallest, and the pitches of the G and B discharge cells can be greater than the pitch of the R discharge cell.

The address electrode 22 formed on the lower substrate 20 can be substantially constant in pitch or width within the discharge cell. Alternatively, the pitch or width within the discharge cell can be different from a pitch or width outside of the discharge cell. For example, the pitch or width within the discharge cell can be greater than that outside of the discharge cell.

Figure 2:
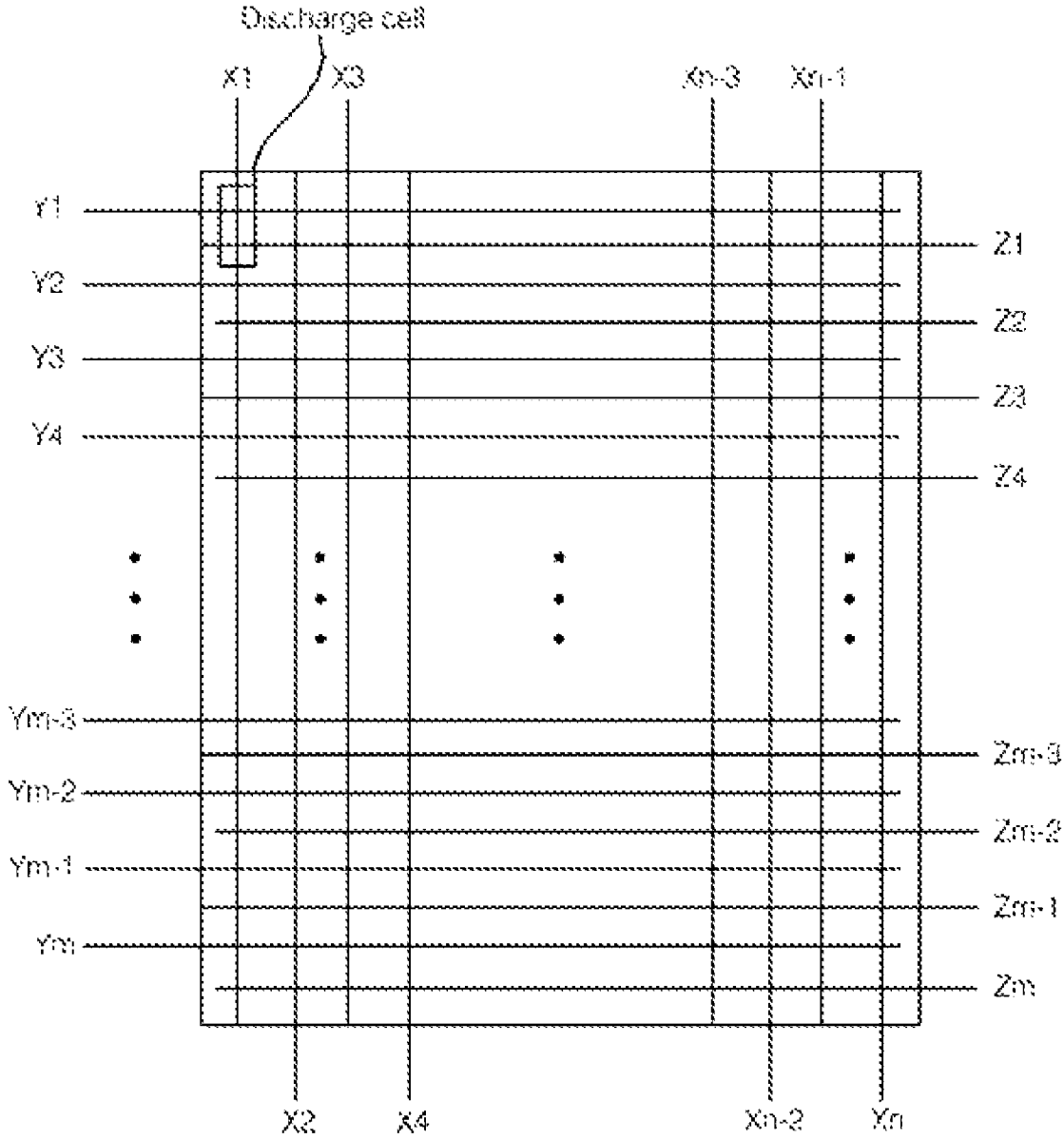
FIG. 2 is a diagram illustrating an electrode arrangement of a plasma display panel according to an exemplary embodiment of the present invention.

FIG. 2 is a diagram illustrating an electrode arrangement of the plasma display panel according to an exemplary embodiment of the present invention. It is desirable that a plurality of discharge cells constituting the plasma display panel are arranged in matrix form as shown in FIG. 2. The plurality of discharge cells are provided at intersections of the scan electrode lines (Y1 to Ym) and the sustain electrode lines (Z1 to Zm), and the address electrode lines (X1 to Xn), respectively. The scan electrode lines (Y1 to Ym) can be driven sequentially or simultaneously. The sustain electrode lines (Z1 to Zm) can be driven simultaneously. The address electrode lines (X1 to Xn) can be divided into odd-numbered lines and even-numbered lines and driven, or can be driven sequentially.

The electrode arrangement of FIG. 2 is merely exemplary for the plasma display panel according to the present invention. Thus, the present invention is not limited to the electrode arrangement of the plasma display panel of FIG. 2 and a driving method thereof. For example, the present invention can also provide a dual scan method or a double scan method for simultaneously driving two ones among the scan electrode lines (Y1 to Ym). The dual scan method refers to a method for simultaneously driving two scan electrode lines belonging to respective upper and lower regions, by partitioning a plasma display panel as the two upper and lower regions. The double scan method refers to a method for simultaneously driving two scan electrode lines sequentially arranged.

Figure 3:
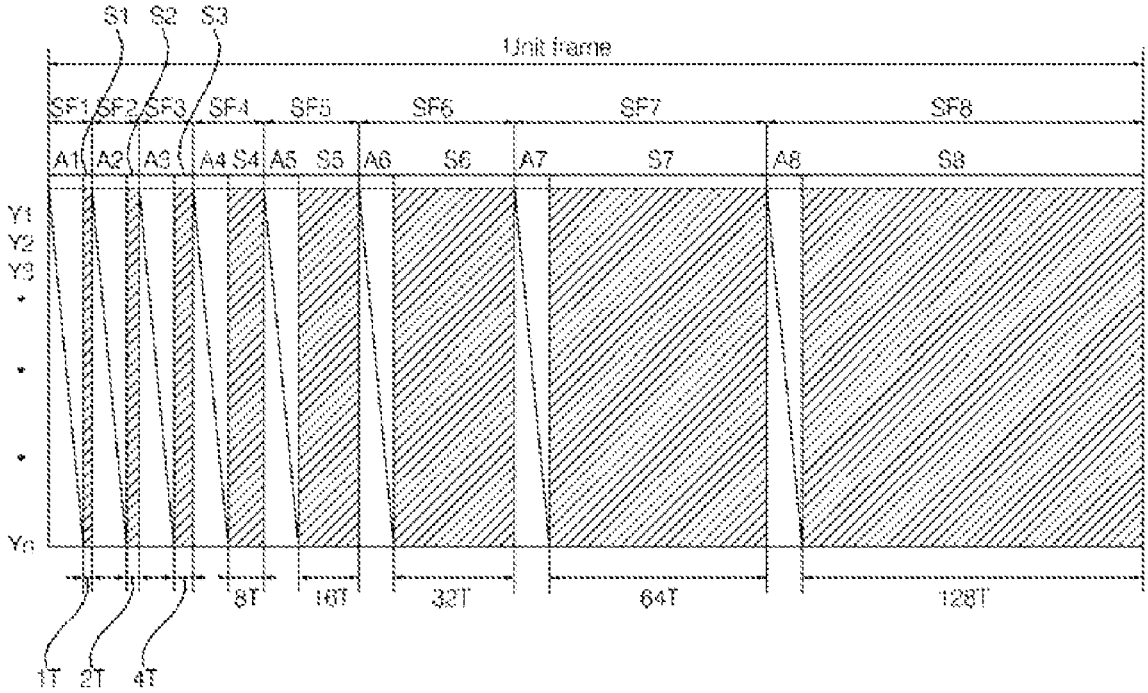
FIG. 3 is a timing diagram illustrating a method for time-division driving a plasma display panel by dividing one frame into a plurality of subfields according to an exemplary embodiment of the present invention.

FIG. 3 is a diagram illustrating a method of time-division driving the plasma display apparatus by dividing one unit frame into a plurality of subfields according to an exemplary embodiment of the present invention. The unit frame can be divided into a predetermined number of subfields, e.g. eight subfields (SF1, . . . , SF8) to realize time-division gray level display. Each subfield (SF1, . . . , SF8) is divided into a reset period (not shown), an address period (A1, . . . , A8), and a sustain period (S1, . . . , S8).

In an exemplary embodiment of the present invention, the reset period can be omitted from at least one of the plurality of subfields. For example, the reset period can exist only at a first subfield, or can exist only at the first field and an approximately middle subfield among the whole subfield.

During each address period (A1, . . . , A8), a display data signal is applied to the address electrode (X), and a scan pulse associated with each scan electrode (Y) is sequentially applied to each scan electrode (Y).

During each sustain period (S1, . . . , S8), a sustain pulse is alternately applied to the scan electrode (Y) and the sustain electrode (Z), thereby inducing a sustain discharge in the discharge cell having wall charges formed in the address periods (A1, . . . , A8).

In the plasma display panel, luminance is proportional to the number of sustain discharge pulses within the sustain discharge periods (S1, . . . , S8) of the unit frame. In case where one frame constituting one image is expressed by 8 subfields and 256 gray levels, the sustain pulses different from each other can be assigned to each subfield in a ratio of 1:2:4:8:16:32:64:128 in regular sequence. The cells are addressed and the sustain discharges are performed during the subfield1 (SF1), the subfield3 (SF3), and the subfield8 (SF8) so as to acquire luminance based on 133 gray levels.

The number of sustain discharges assigned to each subfield can be variably decided depending on subfield weights based on an Automatic Power Control (APC) level. In detail, the present invention is not limited to the exemplary description of FIG. 3 where one frame is divided into eight subfields, and can variously modify the number of subfields constituting one frame depending on a design specification. For example, one frame can be divided into 9 subfields or more like 12 subfields or 16 subfields to drive the plasma display panel.

The number of sustain discharges assigned to each subfield can be diversely modified considering a gamma characteristic or a panel characteristic. For example, a gray level assigned to the subfield4 (SF4) can decrease from 8 to 6, and a gray level assigned to the subfield6 (SF6) can increase from 32 to 34.

Figure 4:
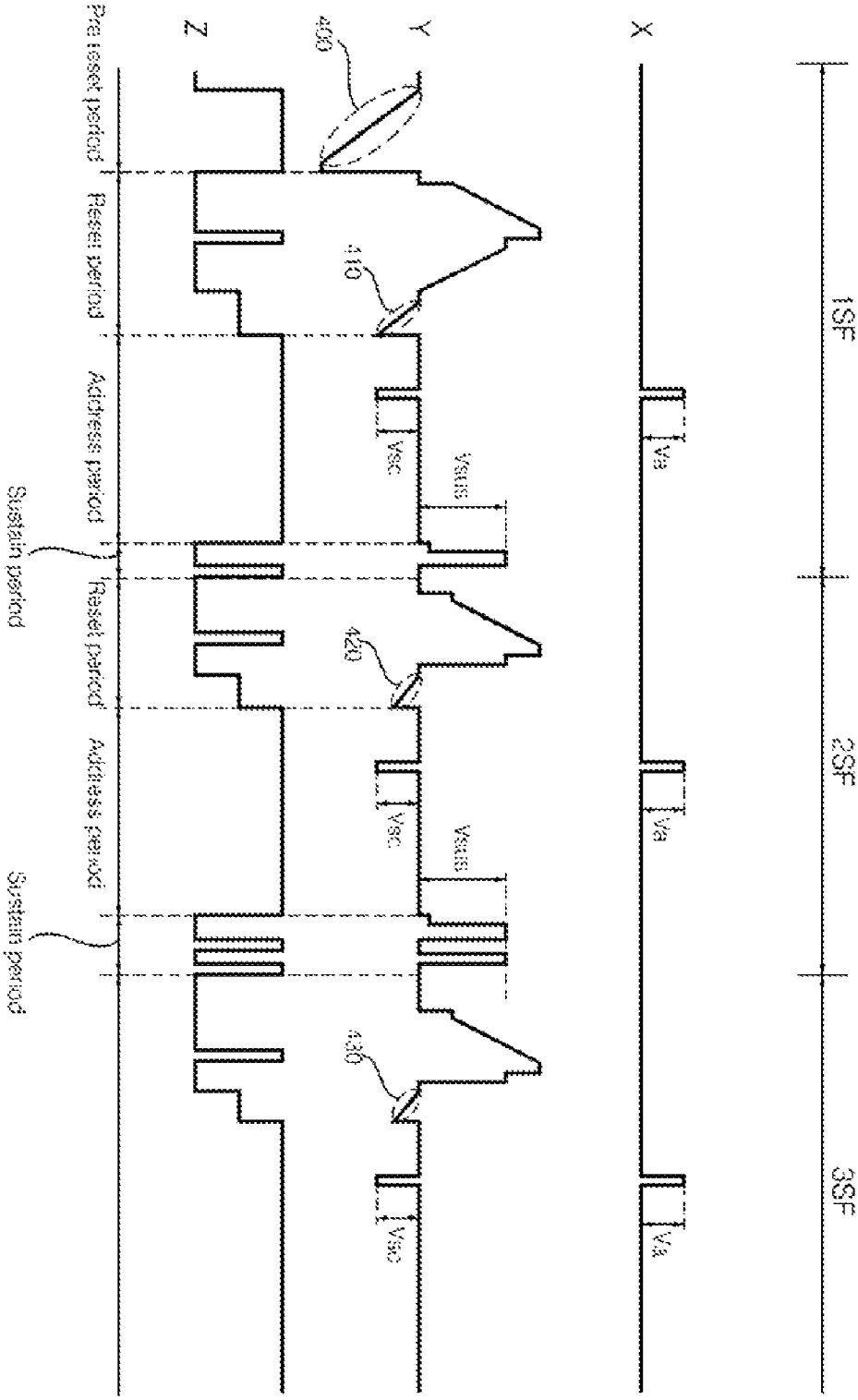
FIG. 4 is a timing diagram illustrating driving signals for driving a plasma display panel for one divided subfield according to an exemplary embodiment of the present invention.

FIG. 4 is a timing diagram illustrating driving signals for driving the plasma display panel for one subfield according to an exemplary embodiment of the present invention.

The subfield includes a pre reset period for forming positive wall charges on the scan electrodes (Y) and forming negative wall charges on the sustain electrodes (Z); the reset period for initializing the discharge cells of a whole screen using a distribution of the wall charges formed during the pre reset period; the address period for selecting the discharge cell; and the sustain period for sustaining the discharge of the selected discharge cell.

The reset period is comprised of a gradual rise setup period, an abrupt fall period, and a gradual fall setdown period. During the setup period, a ramp-up waveform is concurrently applied to all the discharge cells, thereby inducing a minute discharge in all the discharge cells and thus generating the wall charges. During the setdown period, a ramp-down waveform ramping down in a positive voltage lower than a peak voltage (Vramp) of the ramp-up waveform is concurrently applied to all the scan electrodes (Y), thereby inducing an erasure discharge in all the discharge cells and thus erasing unnecessary charges from space charges and the wall charges that are generated by the setup discharge.

Average slopes of the ramp-down waveforms supplied in the setdown periods of the plurality of subfields have values of 2 or more. In other words, the average slopes of the ramp-down waveforms supplied in the plurality of subfields cannot be all identical. A slope (r1) of a pre reset signal 400 can be gentler, that is, smaller than average slopes (r2, r3, and r4, . . . ) of other ramp-down signals 410, 420, 430, . . . . A luminance point erroneous discharge reduces as the slope (r1) of the pre reset signal 400 is gentle.

It is desirable that the average slope (r2) of the ramp-down signal 410 supplied in the first subfield is gentler than the average slopes (r3, r4, . . . ) of the ramp-down signals 420, 430, . . . supplied in other subfields. The luminance point erroneous discharge reduces as the average slope (r2) of the ramp-down signal 410 supplied in the first subfield. The slopes (r3, r4, . . . ) of the ramp-down signals 420, 430, . . . supplied in a second subfield to a last subfield can be more abrupt than the slope (r2) of the ramp-down signal 410 supplied in the first subfield, thereby sufficiently guaranteeing panel driving timing.

The average slopes (r3, r4, . . . ) of the ramp-down signals 420, 340, . . . supplied in the second subfield to the last subfield can be different at least one. For example, the average slope of the ramp-down signal can be greater as the subfield lags temporally.

The luminance point erroneous discharge is much more generated at a low temperature in view of a characteristic of the plasma display panel. Thus, it is desirable that the average slopes (r2, r3, r4 . . . ) of the ramp-down signals 410, 420, 430, . . . are gentler at the low temperature than at a room temperature. A flickering phenomenon is much more generated at a high temperature. Thus, it is desirable that the slopes (r2, r3, r4, . . . ) of the ramp-down signals 410, 420, 430, . . . are more abrupt at the high temperature than at the room temperature. In an exemplary embodiment of the present invention, it is desirable that the low temperature is 20° C. or less, and the high temperature is 40° C. or more.

Figure 7A:
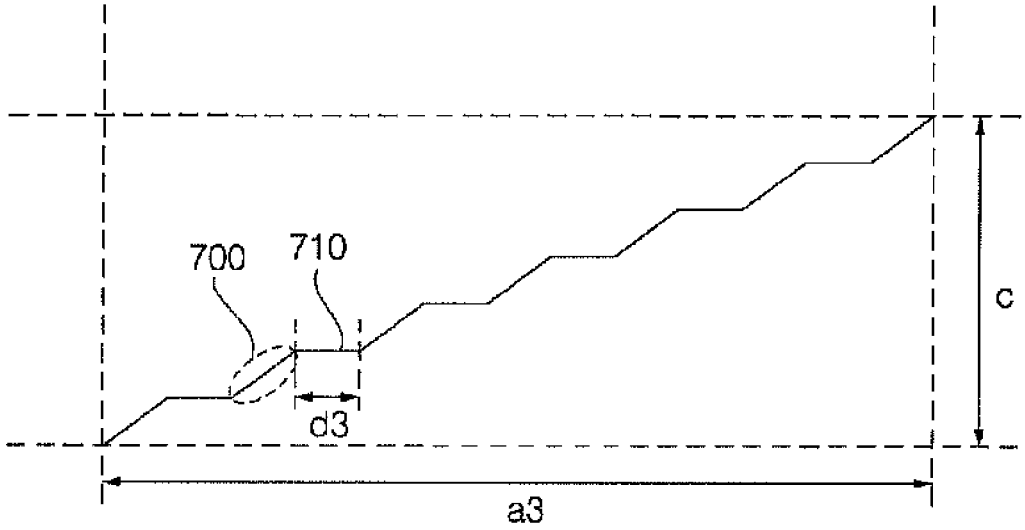
FIGS. 7A and 7B are diagrams illustrating a waveform of the ramp-up signal of the reset period of FIG. 4 according to exemplary embodiments of the present invention.
Figure 7B:
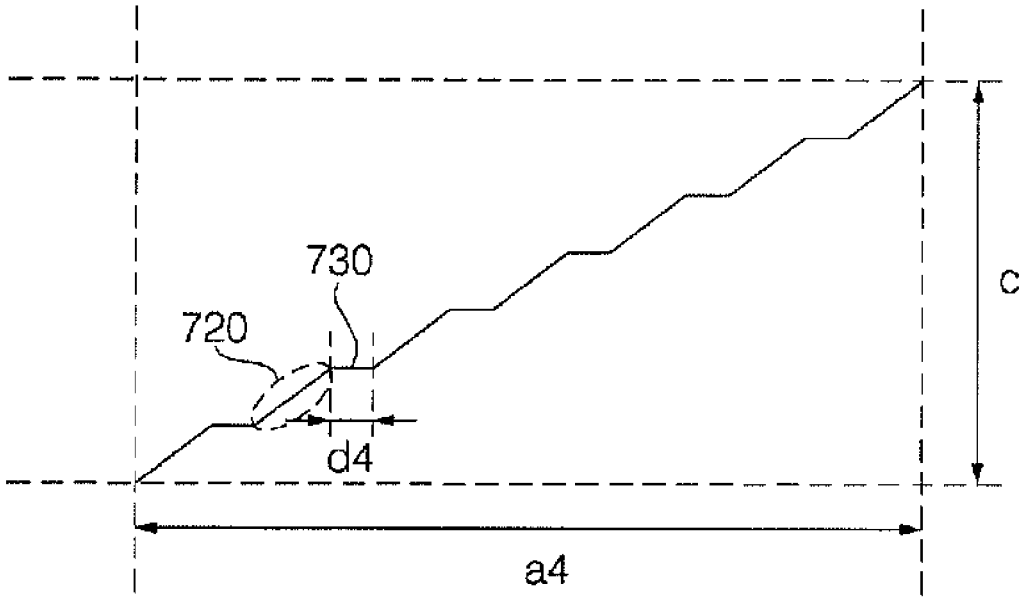

In the above description, the ramp-down signal is exemplified for a waveform of a reset signal according to the present invention. A method for controlling the slope of the ramp-down signal as described above is identically applicable even to a ramp-up signal supplied in the setup period, as shown in FIGS. 7A and 7B.

As shown in FIG. 4, the signals 400, 410, and 420 having voltages of about 50 V to 250 V are supplied to the sustain electrodes (Z) during the reset period. Desirably, the signals 400, 410, and 420 supplied to the sustain electrodes (Z) have voltages of about 150 V to 210 V. More desirably, the signals 400, 410, and 420 are identical with a sustain voltage (Vsus), which is a voltage of a sustain signal alternately supplied to the scan electrode (Y) and the sustain electrode (Z) during the sustain period. Supply time points and voltage magnitudes of the signals 400, 410, and 420 supplied to the sustain electrodes (Z) will be in detail described below.

In an address period, a negative scan signal having a magnitude of a scan voltage (Vsc) is sequentially supplied to the scan electrode and at the same time, a positive data signal is supplied to the address electrode (X). An address discharge is induced by a voltage difference between the scan signal and the data signal and a wall voltage generated during the reset period, thereby selecting the discharge cell. During the set-down period and the address period, a signal sustaining the sustain voltage (Vsus) is supplied to the sustain electrode.

In the sustain period, the sustain signal having the sustain voltage (Vsus) is alternately supplied to the scan electrode and the sustain electrode, thereby inducing a sustain discharge between the scan electrode and the sustain electrode in a surface discharge type.

Driving waveforms of FIG. 4 are the driving signals for driving the plasma display panel according to an exemplary embodiment of the present invention, and are not intended to limit the scope of the present invention. For example, the pre reset period can be omitted. The driving signals of FIG. 4 can change in polarity and voltage level according to need. After the completion of the sustain discharge, an erasure signal for erasing the wall charges can be also applied to the sustain electrode. Single sustain driving is also possible in which the sustain signal is applied to only one of the scan electrode (Y) and the sustain electrode (Z), thereby inducing the sustain discharge.

Figure 5A:
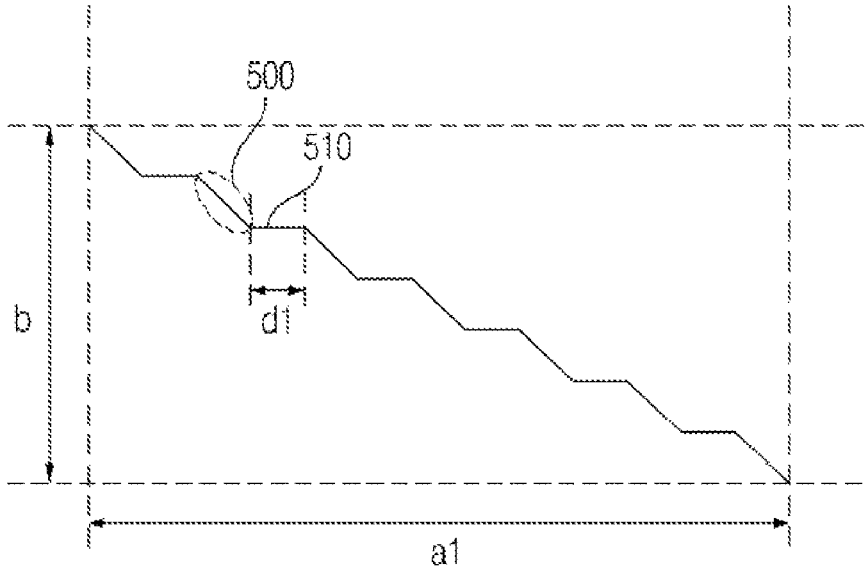
FIGS. 5A and 5B are diagrams illustrating a waveform of a ramp-down signal of a reset period of FIG. 4 according to exemplary embodiments of the present invention.
Figure 5B:
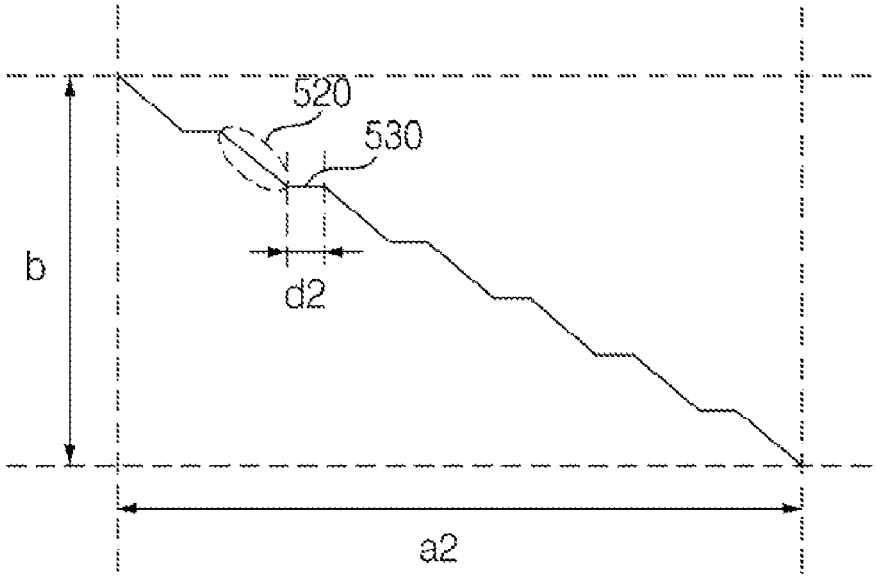

FIGS. 5A and 5B diagrams illustrating a waveform of the ramp-down signal of the reset period of FIG. 4 according to exemplary embodiments of the present invention.

Referring to FIG. 5A, the ramp-down signal includes a plurality of gradual fall periods 500, and a sustain period 510 sustaining a predetermined voltage between the fall periods. It is desirable that slopes of the plurality of fall periods 500 are all identical with each other. An average slope of the ramp-down waveform shown in FIG. 5A has a value of b/a1. The average slope varies depending on a time duration (d1) of the sustain period. Even though the slope of the fall period does not vary, that is, if the time duration (d1) of the sustain period varies without modifying a driving circuit, the average slope of the ramp-down signal can vary. In other words, the average slope of the ramp-down signal is gentle when the time duration (d1) of the sustain period increases, and the average slope of the ram-down signal is abrupt when the time duration (d1) of the sustain period decreases.

FIG. 5B illustrates a ramp-down signal in which a time duration of a sustain period is set shorter than that of FIG. 5A. A slope and a time duration of a fall period 520 are identical with those of FIG. 5A. As described above, an average slope (b/a2) of the ramp-down signal of FIG. 5B is more abrupt than the average slope (b/a1) of the ramp-down signal of FIG. 5A as the time duration (d2) of the sustain period 530 is set short.

A method for varying the average slope of the ramp-down signal described with reference to FIGS. 5A and 5B is identically applicable to varying an average slope of a ramp-up signal gradually rising in the setup period. In detail, as shown in FIGS. 7A and 7B, the ramp-up signal is constructed by a plurality of rise periods having the same slope, and a sustain period sustaining a predetermined voltage between the two neighbor rise periods. The average slope of the ramp-up signal can vary by varying the time duration of the sustain period.

Figure 6:
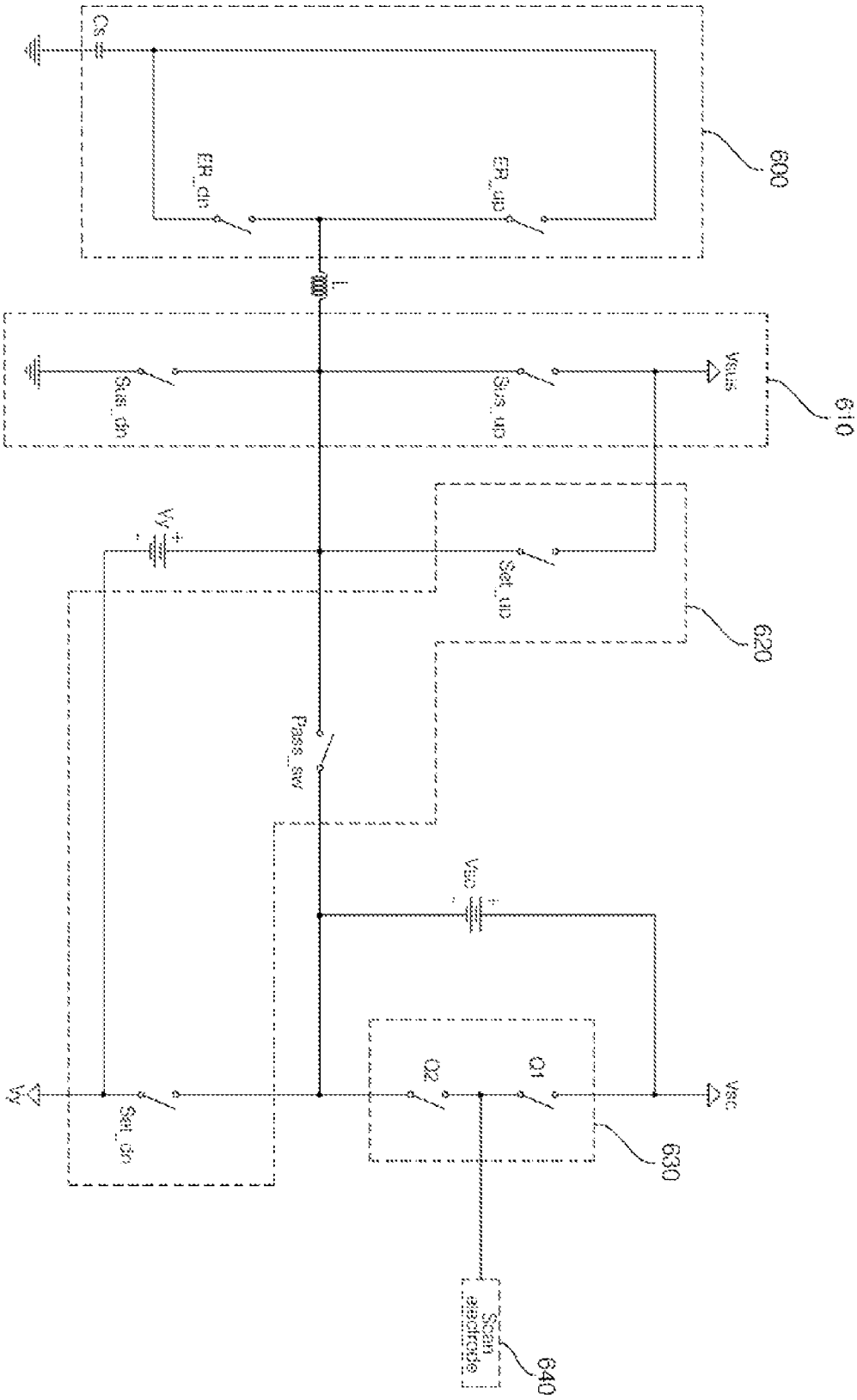
FIG. 6 is a circuit diagram illustrating a construction of a scan driving circuit according to an exemplary embodiment of the present invention.

FIG. 6 is a circuit diagram illustrating a construction of a scan driving circuit according to an exemplary embodiment of the present invention. The scan driving circuit of FIG. 6 includes an energy recovery unit 600, a sustain driver 610, a reset driver 620, and a scan Integrated Circuit (IC) 630.

The sustain driver 610 includes a sustain voltage source (Vsus) for supplying a high electric potential sustain voltage (Vsus) during a sustain period; a sus-up switch (Sus_up) turning on to supply the sustain voltage (Vsus) to a scan electrode 640; a sus-down switch (Sus_dn) turning on so that a voltage supplied to the scan electrode 640 falls to the ground voltage. In other words, in the sustain driver 610, the sus-up switch (Sus_up) connects with the sustain voltage (Vsus), and the sus-down switch (Sus-dn) connects with the sus-up switch (Sus_up) and the ground.

The energy recovery unit 600 includes a source capacitor (Cs) for recovering and storing energy supplied to the scan electrode 640; an energy supply switch (ER_up) turning on to supply the energy stored in the source capacitor (Cs) to the scan electrode 640; and an energy recovery switch (ER_dn) turning on to recover the energy from the scan electrode 640.

The reset driver 620 includes a set-up switch (Set_up) turning on to supply a ramp-up signal, which gradually rises, to the scan electrode 640; a set-down switch (Set_dn) connecting with a negative voltage (−Vy), and turning on to supply a ramp-down signal, which gradually falls to the negative voltage (−Vy), to the scan electrode 640; and a pass switch (Pass_sw) forming a current pass path together with the scan electrode 640.

As shown in FIG. 6, the set-up switch (Set_up) has a drain connecting to the sustain voltage source, a source connecting to the pass switch (Pass_sw), and a gate connecting with a variable resistor (not shown). The set-up switch (Set_up) generates a signal that gradually rises depending on a resistance variation of the variable resistor.

The set-down switch (Set_dn) has a drain connecting to the scan IC 630, a source connecting to the negative voltage (−Vy), and a gate connecting with a variable resistor (not shown). The set-down switch (Set_dn) generates a signal that gradually falls depending on a resistance variation of the variable resistor.

As shown in FIGS. 5A and 5B, the signals rising or falling with the constant slopes obtained as above are supplied to the scan electrode 640. The setup switch (Set_up) or the setdown switch (Set_dn) can turn off during the time durations (d1 and d2) of the sustain period, which are preset between the rising or falling signals, to sustain a voltage, thereby varying the slope of the rising or falling signal.

The scan IC 630 includes a scan-up switch (Q1) turning on to supply a scan voltage (Vsc) to the scan electrode 640, and connecting with a scan voltage source; and a scan-down switch (Q2) turning on to supply the ground voltage to the scan electrode 640.

In order to supply a scan signal to the scan electrode 640, the sus-down switch (Sus_dn), the pass switch (Pass_sw), and the scan-up switch (Q1) turn on, so that a voltage supplied to the scan electrode 640 rises to the scan voltage (Vsc). Also, the sus-down switch (Sus_dn), the pass switch (Pass_sw), and the scan-down switch (Q2) turn on, so that the voltage supplied to the scan electrode 640 falls to the ground voltage.

In the above-constructed plasma display apparatus according to the present invention, when the reset signal is supplied to the plasma display panel, the slope of the gradually rising or falling signal among the reset signals can be controlled about 2 or more, thereby preventing the luminance point erroneous discharge of the display image and sufficiently guaranteeing the driving margin and at the same time, reducing a black luminance and improving a contrast ratio.

Referring to FIG. 7A, the ramp-up signal includes a plurality of gradual rising periods 700, and a sustain period 710 sustaining a predetermined voltage between the rising periods. It is desirable that slopes of the plurality of rising periods 700 are all identical with each other. An average slope of the ramp-up waveform shown in FIG. 7A has a value of c/a3. The average slope varies depending on a time duration (d3) of the sustain period. Even though the slope of the rising period does not vary, that is, if the time duration (d3) of the sustain period varies without modifying a driving circuit, the average slope of the ramp-up signal can vary. In other words, the average slope of the ramp-up signal is gentle when the time duration (d3) of the sustain period increases, and the average slope of the ramp-up signal is abrupt when the time duration (d3) of the sustain period decreases.

FIG. 7B illustrates a ramp-up signal in which a time duration of a sustain period is set shorter than that of FIG. 7A. A slope and a time duration of a rising period 720 are identical with those of FIG. 7A. As described above, an average slope (c/a4) of the ramp-up signal of FIG. 7B is more abrupt than the average slope (c/a3) of the ramp-up signal of FIG. 7A as the time duration (d4) of the sustain period 730 is set short.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

a plasma display panel having a plurality of discharge cells, and time-division components driven by dividing a unit frame into a plurality of subfields; and a driver for supplying a reset signal for initializing the plurality of discharge cells to a scan electrode of the panel in a reset period, wherein the driver supplies rising setup signals to the scan electrode in reset periods of the plurality of subfields, and an average slope of the rising setup signal supplied in a first subfield among the plurality of subfields is different from an average slope of the rising setup signal supplied in a second subfield, wherein the rising setup signal comprises two or more variation periods for which the setup signal rises with a first slope, and the rising setup signal comprises two or more sustain periods for sustaining a predetermined voltage between two adjacent variation periods among the variation periods, wherein a time duration of the two or more sustain periods for sustaining a predetermined voltage between two adjacent variation periods among the variations periods are the same in the rising setup signal supplied in the plurality of subfields, wherein the first slope of the two or more variation periods are the same in the rising setup signal supplied in the plurality of subfields, and wherein the time duration of the two or more sustain periods for sustaining a predetermined voltage between two adjacent variation periods among the variations periods of the rising setup signal supplied in a first subfield is different from a time duration of the two or more sustain periods of the rising setup signal supplied in a second subfield.

2. The apparatus of claim 1, wherein the first slope is identical for the plurality of subfields.

3. The apparatus of claim 1, wherein the average slope of the rising setup signal supplied in the first subfield is smaller than average slopes of the rising setup signals supplied in other subfields.

4. The apparatus of claim 1, wherein as a temperature of the panel becomes 20° C. or less the average slope of the rising setup signal is decreased from a first average slope value at room temperature.

5. The apparatus of claim 1, wherein the average slope of the rising setup signal supplied in the first subfield is smaller than average slopes of the rising setup signals supplied in at least one other subfield.

6. The apparatus of claim 1, wherein when a temperature of the panel is 20° C. or less the average slope of the rising setup signal is smaller than a first average slope value at room temperature.

7. The apparatus of claim 1, wherein the average slope of the rising setup signal supplied in the first subfield depends upon time durations of the two or more sustain periods of the rising setup signal in the reset period.

8. A plasma display apparatus comprising:

a plasma display panel having a plurality of discharge cells, and time-division components driven by dividing a unit frame into a plurality of subfields; and a driver for supplying a reset signal for initializing the plurality of discharge cells to a scan electrode of the panel in a reset period, wherein the driver supplies falling setdown signals to the scan electrode in reset periods of the plurality of subfields, and an average slope of the falling setdown signal supplied in a first subfield among the plurality of subfields is different from an average slope of the setdown signal supplied in a second subfield, wherein the falling setdown signal comprises two or more variation periods for which the setdown signal falls with a first slope, and the falling setdown signal comprises two or more sustain periods for sustaining a predetermined voltage between two adjacent variation periods among the variation periods, wherein a time duration of the two or more sustain periods for sustaining a predetermined voltage between two adjacent variation periods among the variations periods among the variations periods are the same in the falling setdown signal supplied in the plurality of subfields, wherein the first slope of the two or more variation periods are the same in the falling setdown signal supplied in the plurality of subfields, and wherein the time duration of the two or more sustain periods for sustaining a predetermined voltage between two adjacent variation periods among the variations periods of the falling setdown signal supplied in a first subfield is different from a time duration of the two or more sustain periods of the falling setdown signal supplied in a second subfield.

9. The apparatus of claim 8, wherein the first slope is identical for the plurality of subfields.

10. The apparatus of claim 8, wherein the driver supplies a falling pre reset signal to the scan electrode to form positive wall charges in the scan electrode and form negative wall charges in a sustain electrode, and an average slope of the falling setdown signal supplied in other subfields is smaller than an average slope of the falling pre reset signal.

11. The apparatus of claim 8, wherein the average slope of the falling setdown signal supplied in the first subfield is smaller than average slopes of the falling setdown signals supplied in at least one other subfield.

12. The apparatus of claim 8, wherein as a temperature of the panel becomes 20° C. or less the average slope of the falling setdown signal is decreased from a first average slope value at room temperature.

13. The apparatus of claim 8, wherein the falling setdown signal is terminated with the variation period, and a signal having an abruptly rising voltage is supplied to the scan electrode sequentially to a last variation period of the falling setdown signal.

14. A plasma display apparatus comprising:

a plasma display panel having a plurality of discharge cells, and time-division components driven by dividing a unit frame into a plurality of subfields; and a driver for supplying a reset signal for initializing the plurality of discharge cells to a scan electrode of the panel in a reset period, wherein the driver supplies rising or falling ramp signals to the scan electrode in reset periods of the plurality of subfields, and the rising or falling ramp signal comprises two or more rising or falling variation periods for which the rising or falling ramp signal rises or falls with a first slope, and the rising or falling ramp signal comprises two or more sustain periods for sustaining a predetermined voltage between two adjacent variation periods among the variation periods, wherein a time duration of the two or more sustain periods for sustaining a predetermined voltage between two adjacent variation periods among the variations periods are the same in the rising or falling ramp signal supplied in the plurality of subfields, wherein the first slope of the two or more variation periods are the same in the rising or falling ramp signal supplied in the plurality of subfields, and wherein the time duration of the two or more sustain periods for sustaining a predetermined voltage between two adjacent variation periods among the variations periods of the rising or falling ramp signal supplied in a first subfield is different from a time duration of the two or more sustain periods of the rising or falling ramp signal supplied in a second subfield.

15. The apparatus of claim 14, wherein the first slope is identical for the plurality of subfields.

16. The apparatus of claim 14, wherein the driver supplies a falling pre reset signal to the scan electrode to form positive wall charges in the scan electrode and form negative wall charges in a sustain electrode, and an average slope of the rising or falling ramp signal supplied in other subfields is smaller than an average slope of the falling pre reset signal.

17. The apparatus of claim 14, wherein the average slope of the rising or falling ramp signal supplied in the first subfield is smaller than average slopes of the rising or falling ramp signals supplied in other subfields.

18. The apparatus of claim 14, wherein as a temperature of the panel becomes 20° C. or less the average slope of the rising or falling ramp signal is decreased from a first average slope value at room temperature.

* * * * *